US009629465B2

(12) United States Patent
Williams et al.

(10) Patent No.: US 9,629,465 B2
(45) **Date of Patent: *Apr. 25, 2017**

(54) LOUNGE CHAIR

(71) Applicant: Krueger International, Inc., Green Bay, WI (US)

(72) Inventors: Scott J. Williams, Green Bay, WI (US); Timothy G. Hornberger, Green Bay, WI (US); Tad E. Lenhart, De Pere, WI (US); Scott A. Bosman, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/064,793

(22) Filed: Mar. 9, 2016

(65) Prior Publication Data

US 2016/0270541 A1 Sep. 22, 2016

Related U.S. Application Data

(63) Continuation-in-part of application No. 14/661,176, filed on Mar. 18, 2015, now Pat. No. 9,398,811.

(51) Int. Cl.

| | |
|---|---|
| ***A47C 3/02*** | (2006.01) |
| ***A47C 3/025*** | (2006.01) |
| ***A47C 3/12*** | (2006.01) |
| ***A47C 5/12*** | (2006.01) |
| ***A47C 3/18*** | (2006.01) |
| ***A47C 7/44*** | (2006.01) |

(52) U.S. Cl.

CPC ..... *A47C 3/12* (2013.01); *A47C 3/18* (2013.01); *A47C 7/443* (2013.01)

(58) Field of Classification Search

CPC .. A47C 3/18; A47C 3/12; A47C 7/185; A47C 5/12

USPC ..... 297/344.21, 344.22, 344.24, 314, 440.1, 297/440.22, 451.13, 264.1, 270.1, 270.5

See application file for complete search history.

(56) References Cited

U.S. PATENT DOCUMENTS 30,706 A * 11/1860 Van Vleck ..... A47C 9/002 297/314
1,295,059 A * 2/1919 Petterson ..... B60N 2/502 297/314 X (Continued)

FOREIGN PATENT DOCUMENTS

EP 2 568 852 B1 6/2014

*Primary Examiner* — Rodney B White

(74) *Attorney, Agent, or Firm* — Andrus Intellectual Property Law, LLP

(57) ABSTRACT

A lounge chair having a seat shell that defines a chair back and a seat is pivotally movable about a stationary base. The stationary base includes a concave support surface having a shape that generally corresponds with a convex outer surface of the seat shell. A swivel disc is positioned between the seat shell and the base to allow the seat shell to pivot about the stationary base. The interaction between a pivot post formed on the base and a pivot limiting guide formed in the seat shell defines the range of movement for the seat shell. A bias member connects the seat shell to the seat base and creates a bias force to urge the seat shell into an upright seating position. The base includes a series of glide buttons that support the swivel disc to allow the seat shell to pivot relative to the stationary base.

19 Claims, 12 Drawing Sheets

(56) References Cited

U.S. PATENT DOCUMENTS 1,398,935 A * 11/1921 Miller ..... A47C 3/0252 297/314 X
1,429,979 A * 9/1922 Spanenberg ..... B60N 2/39 297/314 X
2,719,571 A * 10/1955 Taylor ..... A47C 9/002 297/314 X
2,808,828 A * 10/1957 Rubin ..... A47C 21/006 5/109
2,920,685 A * 1/1960 Trebilcock ..... A47D 13/10 297/314
D211,170 S 5/1968 Carsello
3,718,365 A * 2/1973 Gibson ..... B63B 29/04 297/344.24 X
4,208,072 A * 6/1980 Iskendarian ..... A47C 3/04 297/440.22 X
4,294,426 A 10/1981 Fleischer
4,588,226 A * 5/1986 Young ..... A47C 3/18 297/344.24 X
4,598,946 A * 7/1986 Cone ..... A47D 13/107 297/258.1
4,659,053 A * 4/1987 Holley ..... F16M 11/14 248/133
4,671,572 A * 6/1987 Young ..... A47C 3/18 297/344.24 X
4,974,904 A * 12/1990 Phillips ..... A47C 9/002 297/258.1
D348,361 S 7/1994 Beecher
5,590,930 A * 1/1997 Glockl ..... A47C 3/0257 297/258.1
5,728,049 A * 3/1998 Alberts ..... A47C 9/002 297/314
D420,520 S 2/2000 Johnston
6,116,682 A * 9/2000 Baur ..... A47C 3/12 297/344.21 X
6,176,548 B1 1/2001 Thole et al.
6,182,583 B1 * 2/2001 Larson ..... A47B 9/10 297/344.22 X
7,036,883 B1 * 5/2006 Thompson ..... B60N 2/0224 297/344.24
7,140,685 B2 11/2006 Gardner
7,219,961 B2 * 5/2007 Priepke ..... B60N 2/143 297/344.21 X
7,575,276 B1 8/2009 Henry
7,637,570 B2 * 12/2009 Becker ..... A47C 7/28 297/314 X
7,789,463 B2 * 9/2010 Gang ..... A47C 3/0252 297/314 X
7,866,751 B2 * 1/2011 Downey ..... B60N 2/0296 297/344.24 X
7,938,489 B2 * 5/2011 Nazari ..... A47C 3/0257 297/314 X
8,182,036 B2 * 5/2012 Nishino ..... A47C 3/027 297/258.1
8,231,175 B2 * 7/2012 Aminian ..... A47C 9/002 297/314
8,967,716 B2 * 3/2015 Mountz ..... A47C 9/02 297/256.12
9,004,586 B2 * 4/2015 DeCraene ..... B60N 2/14 297/344.24 X
9,398,811 B1 * 7/2016 Williams ..... A47C 3/12
2002/0043846 A1 * 4/2002 Brauning ..... A47C 3/026 297/314
2003/0057755 A1 * 3/2003 Brandt ..... B60N 2/14 297/344.24
2005/0173952 A1 * 8/2005 Van Der Laan ..... A47C 15/004 297/314 X
2009/0188410 A1 7/2009 Billich

* cited by examiner

LOUNGE CHAIR

CROSS REFERENCE TO RELATED APPLICATIONS

This application is a continuation-in-part of U.S. application Ser. No. 14/661,176, filed Mar. 18, 2015, which issued as U.S. Pat. No. 9,398,881 on Jul. 26, 2016, the disclosure of which is incorporated by reference.

BACKGROUND

The present disclosure generally relates to a lounge chair. More specifically, the present disclosure relates to a lounge chair that includes a seat shell that is pivotally mounted to a stationary base.

Presently, many different types of lounge chairs are available that allow a seat occupant to be comfortably seated. In many of these currently available lounge chairs, a mechanism is included in the chair to allow the chair to recline to increase the comfort of the seat occupant. Although different types of pivoting mechanisms are utilized in these types of chairs, many of these mechanisms are complicated, expensive and difficult to manufacture and assemble. Therefore, a need exists for a lounge chair that allows a seat occupant to recline while providing for ease of manufacture, ease of assembly and a desirable visual appearance.

SUMMARY

The present disclosure relates to a lounge chair. More specifically, the present disclosure relates to a lounge chair having a desirable appearance and a seat shell that is pivotally movable relative to a stationary base.

The seat shell of the lounge chair is formed from a molded plastic material and includes a generally open, hollow interior. The seat shell defines an integrally formed seat and chair back to support a seat occupant during use. Both the seat and chair back include a cushion that is mounted to an inner surface of the seat shell.

The bottom portion of the seat shell includes a convex bottom contact surface. The convex bottom contact surface defines a pivot surface for the pivoting movement of the seat shell relative to the stationary base.

The lounge chair includes a stationary base that includes a plurality of support legs that support a center section. The center section of the base includes a concave support surface. The concave support surface has a shape that generally corresponds to the convex bottom contact surface of the seat shell. The base is formed with a pivot post that extends from the support surface of the base and into the hollow interior of the seat shell when the seat shell is received on the base. A retaining disc is positioned within the open interior of the seat shell to hold the seat shell and base together while allowing movement of the seat shell relative to the stationary base.

The lounge chair further includes a swivel disc that is positioned between the contact surface of the seat shell and the support surface of the base. The swivel disc is formed from a material that is more durable than the material that forms the seat shell. In one embodiment, the swivel disc is formed from a polycarbonate material. The swivel disc is attached to the bottom portion of the seat shell and covers the entire convex bottom contact surface of the seat shell.

The seat shell includes a pivot limiting guide that interacts with the pivot post to limit the pivoting movement of the seat shell relative to the base. The pivot limiting guide is formed by a pivot limiting opening defined by a guide edge surface that contacts the pivot post to restrict the pivoting movement of the seat shell relative to the stationary base. The shape of the guide edge surface defines the extent of pivoting movement of the seat shell.

In one embodiment of the disclosure, the lounge chair further includes a bias member that is connected between the seat shell and the base when the seat shell is mounted to the base. The bias member is formed from a resilient material and creates a bias force that urges the seat shell into an upright, seating position. During the reclining movement of the seat shell relative to the seat base, the bias member further stretched to resist the reclining movement. When the seat occupant leaves the chair, the bias force created by the bias member returns the seat shell to the upright, seating position.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
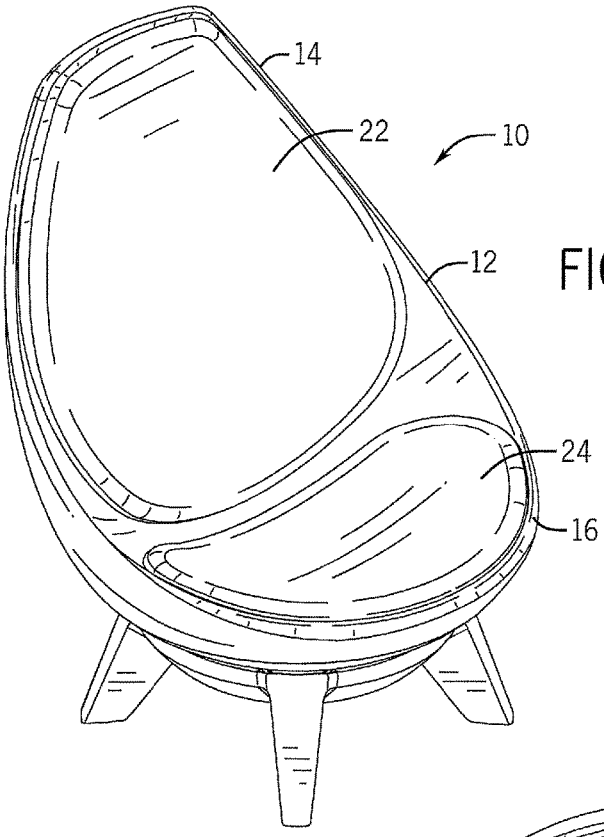
FIG. 1 is an isometric view of the lounge chair of the present disclosure.
Figure 2:
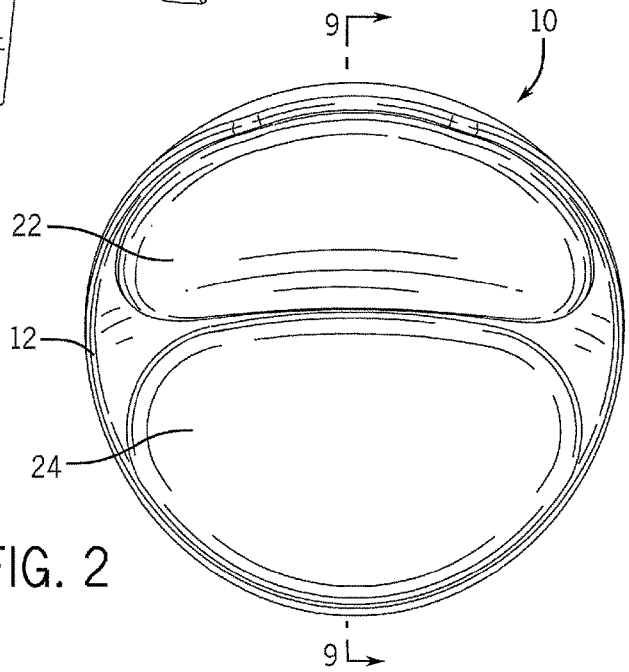
FIG. 2 is a top plan view of the lounge chair.
Figure 3:
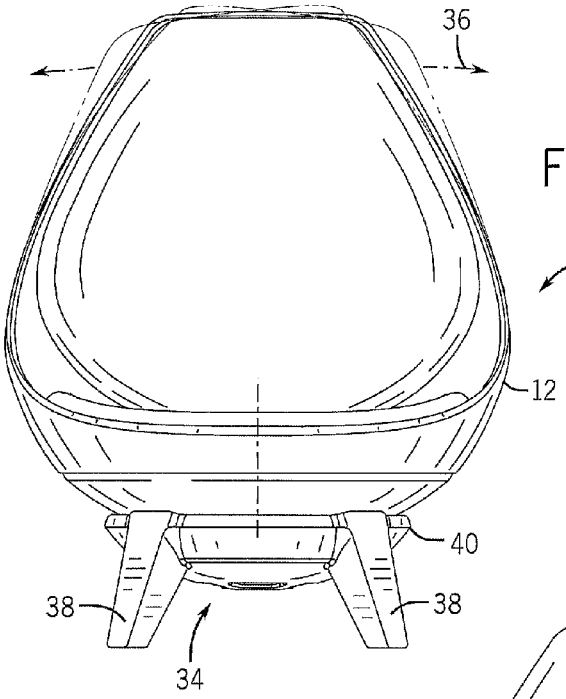
FIG. 3 is a front view of the lounge chair.

FIGS. 1-6 illustrate a lounge chair 10 constructed in accordance with the present disclosure. The lounge chair 10 has a unique, egg-shape, although other shapes are contemplated. The lounge chair 10 includes a seat shell 12 that define a chair back 14 and a seat 16. As can be understood in the section view of FIG. 9, the seat shell 12, which defines the chair back 14 and the seat 16, includes a hollow, open interior 18 that is defined by an outer wall 20. In the embodiment illustrated, the seat shell 12 is formed from rotomolded low density polyethylene (LDPE) such that the chair back 14 and seat 16 are formed as a unitary, hollow member including the open interior 18.

Figure 9:
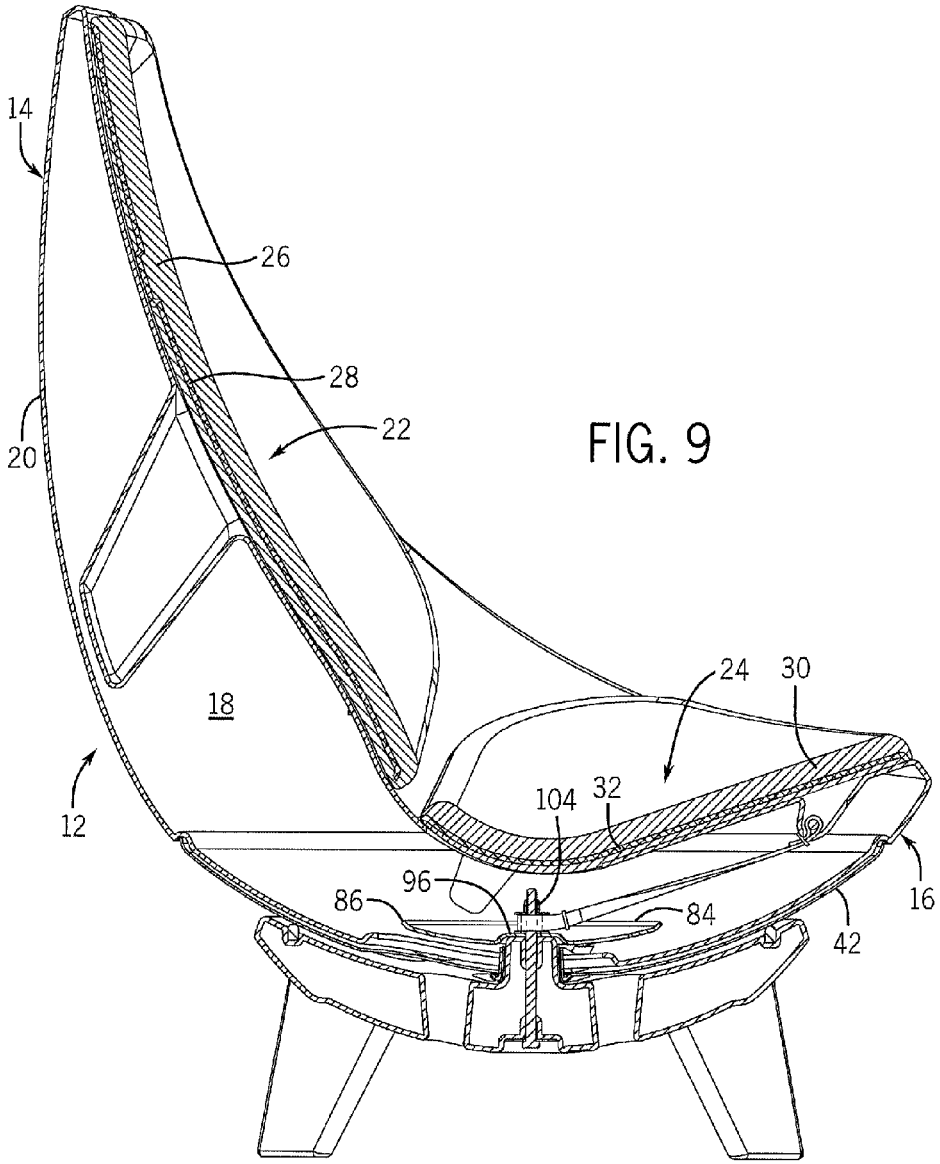
FIG. 9 is a section view taken along 9-9 of FIG. 2 for the lounge chair of FIG. 7.

As illustrated in FIGS. 1 and 9, the chair back 14 includes a back cushion 22 while the seat 16 includes a seat cushion 24. Both the back cushion 22 and the seat cushion can include upholstery to provide a visually desirable appearance. The back cushion 22 includes a foam pad 26 mounted to and supported by a shell 28. The shell 28, in the embodiment illustrated, is formed from polyolefin regrind and provides a stiff, support section for the foam polyurethane pad 26. The seat cushion 24 includes a similar foam pad 30 mounted to a shell 32 formed from the same polyolefin regrind.

Referring back to FIGS. 3-4, the lounge chair 10 further includes a base 34 that supports the seat shell 12. The seat shell 12 and base 34 interact with each other to allow pivoting movement of the seat shell 12 relative to the base 34, as shown by arrows 36 in FIGS. 3 and 5. The base 34 includes a plurality of support legs 38 that each extend from a center section 40 to provide stable support for the base on a support surface, such as a floor.

Figure 4:
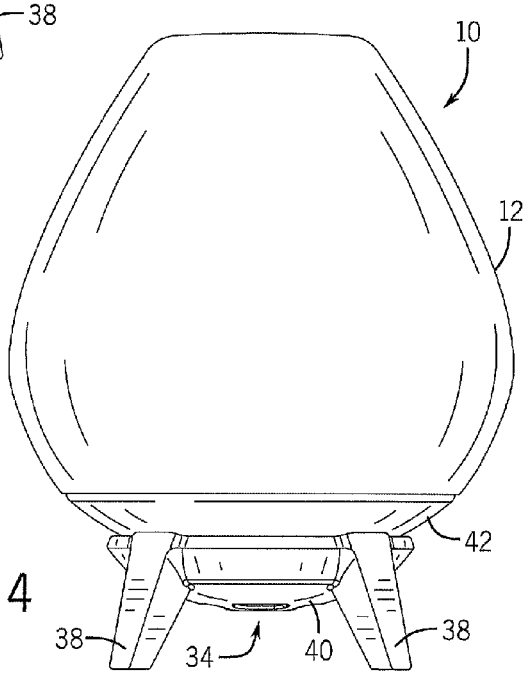
FIG. 4 is a back view of the lounge chair.
Figure 5:
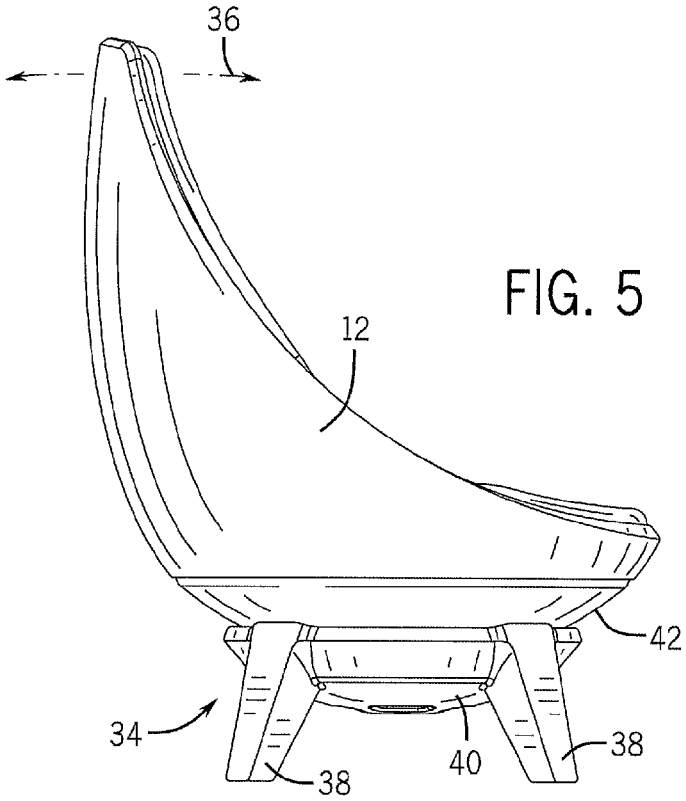
FIG. 5 is a right side view of the lounge chair.
Figure 6:
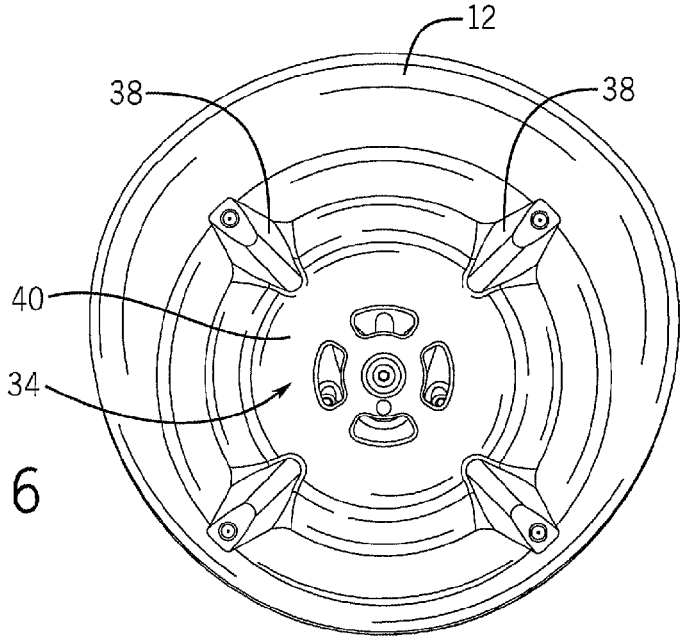
FIG. 6 is a bottom plan view of lounge chair.

As can be seen in FIGS. 4 and 5, a swivel disc 42 is positioned between the seat shell 12 and the base 34. The swivel disc 42 is securely attached to the bottom portion of the seat shell 12 and provides a support surface for the pivoting movement of the seat shell 12 relative to the base 34. In the embodiment illustrated, the swivel disc 42 is formed from a polycarbonate material that is more durable, stronger and more structurally stable than the LDPE that forms the seat shell 16. However, it is contemplated that the swivel disc 42 could be formed from other materials while operating within the scope of the present disclosure.

Figure 7:
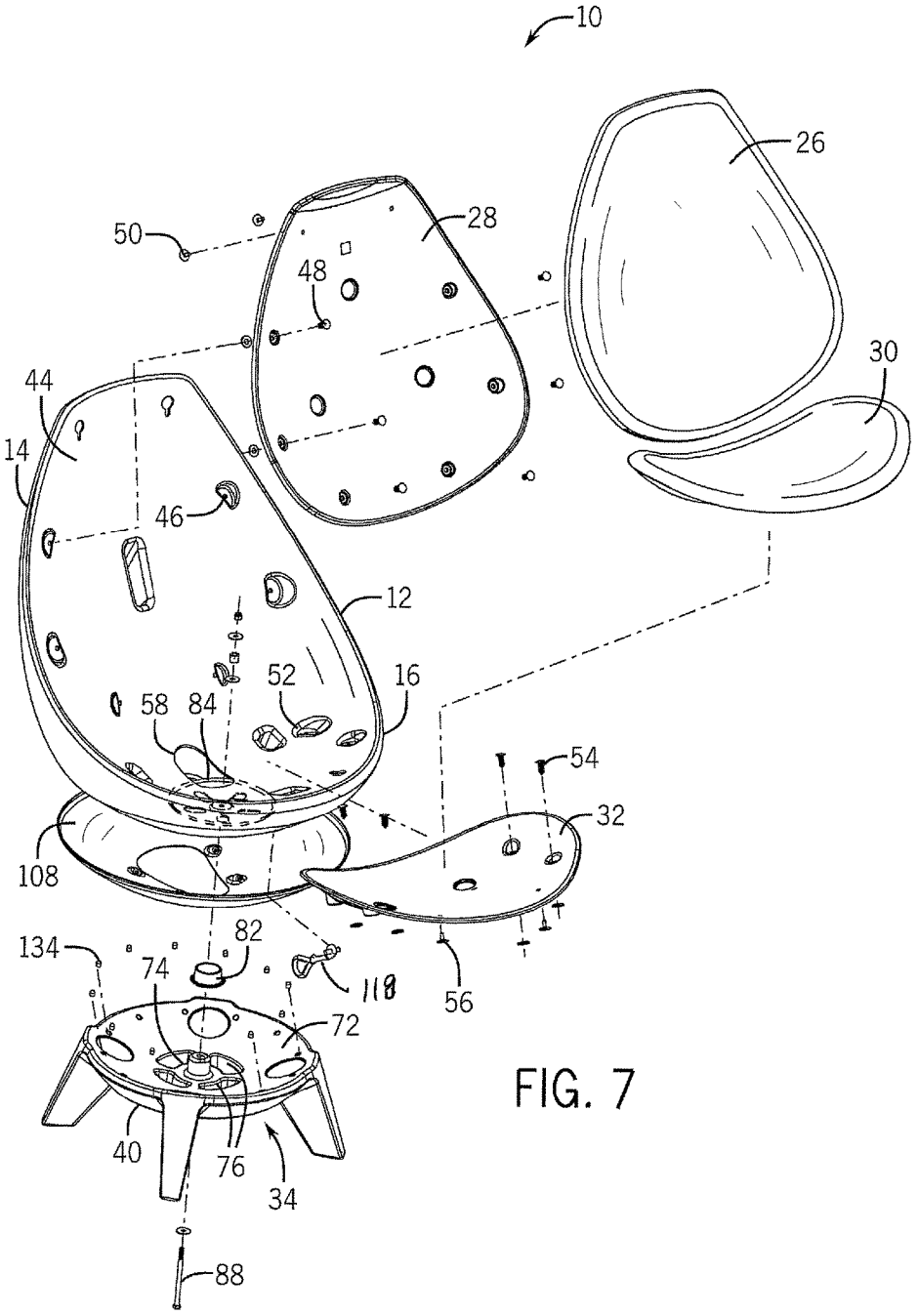
FIG. 7 is an exploded, isometric view of the lounge chair in an embodiment having a tether as the bias member.
Figure 8:
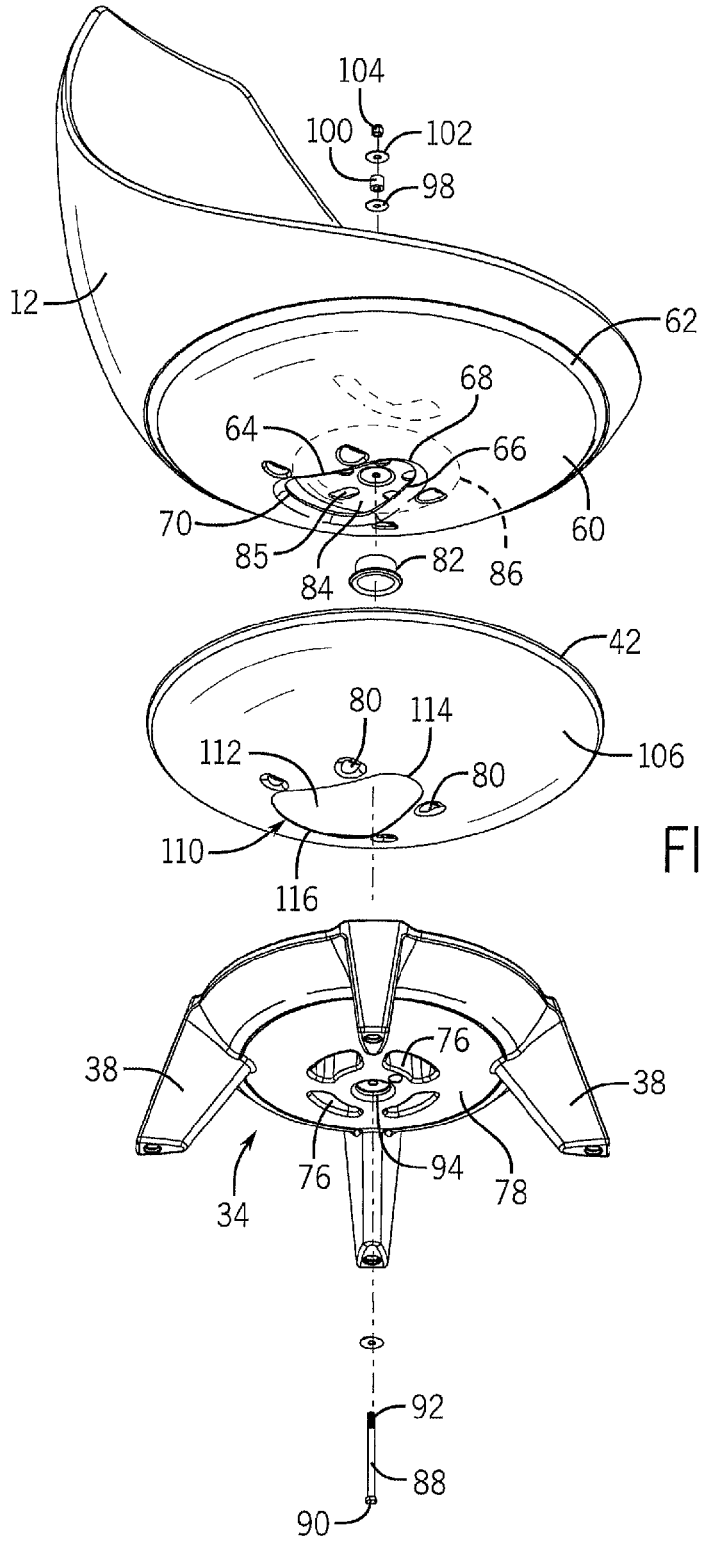
FIG. 8 is an exploded, bottom view of the lounge chair of FIG. 7.

FIGS. 7-8 are each exploded views of the lounge chair 10 of the present disclosure. As shown in FIG. 7, the seat shell 12 includes a generally smooth, inner surface 44 that defines a portion of the seat 16 and the chair back 14. The inner surface 44 includes a plurality of openings 46 that each receives one of a plurality of connectors 48 that attach the shell 28 of the back cushion to the seat shell. A second group of connectors 50 attach the foam pad 26 of the back cushion to the seat shell 28.

Another group of openings 52 formed in the inner surface 44 receive a group of connectors 54 that connect the shell 32 of the seat cushion to the inner surface 44. Connectors 56 attach the foam pad 30 to the shell 32.

The inner surface 44 further includes a drain opening 58 positioned in the seat area 16. The drain opening 58 allows for drainage of liquid that may be spilled by a seat occupant when seated in the lounge chair.

As illustrated in FIG. 8, the seat shell 12 includes a convex bottom contact surface 60. The convex bottom contact surface 60 is positioned beneath the seat portion of the seat shell 12 and is defined at its outer edges by an attachment lip 62. The convex bottom contact surface 60 includes a pivot limiting guide that in the embodiment shown is a pivot limiting opening 64 that is a removed area defined by a guide edge surface 66. The guide edge surface 66 defines a curved front portion 68 and a curved back portion 70. The curved back portion 70 has a width greater than the curved front portion 68.

Referring now to FIG. 7, the center section 40 of the base 34 includes a concave support surface 72. The shape of the concave support surface 72 generally corresponds to the curvature of the convex contact surface 60 formed on the seat shell 12. The shape of the convex contact surface 60 formed on the seat shell and the concave support surface 72 formed on the base 34 allows the seat shell 12 to pivot relative to the base 34.

The center section 40 includes a pivot post 74 that is integrally molded with the center section 40 and is positioned generally at the center of the support surface 72 and extends from the support surface 72. The pivot post 74 is surrounded by a series of openings 76 that extend through the center section from the support surface 72 to a bottom surface 78, as shown in FIG. 8. The openings 76 function as drain holes or openings that allow spilled liquid to pass through the center section 40 and also reduce the weight of the base 34.

Referring back to FIG. 7, a bumper 82 surrounds the pivot post 74. The bumper 82 is formed from a wear resistant material that protects the pivot post 74 during the pivoting movement of the seat shell relative to the base.

Referring now to FIG. 8, a retainer plate 84 is positioned within the open interior defined by the seat shell 12. The retainer plate 84 has an outer diameter defined by an outer edge 86 which is larger than the pivot opening 64. In this manner, the retainer plate 84 is entrapped within the open interior 18 of the seat shell 12, as is best illustrated in FIG. 9. The retainer plate 84 prevents the seat shell 16 from being separated from the base 34 while allowing for pivoting movement between the components. The retainer plate 84 includes a series of spaced drain openings 85 that allow spilled liquids to pass through the retainer plate 84.

As can be understood in FIGS. 8 and 9, a bolt 88, having a head portion 90 and a threaded shaft portion 92, extends through a center opening 94 and through the pivot post 74. The bolt 88 enters into the seat shell as shown in FIG. 9 and passes through a center portion 96 of the retainer plate 84. As can be understood in FIG. 8, a lower washer 98, bushing 100, upper washer 102 and attachment nut 104 are received on the threaded portion of the bolt 88. The combination of these components connects the retainer ring to the pivot post 74.

As discussed previously, the swivel disc 42 is securely attached to the convex contact surface 60 of the seat shell 16 along the attachment lip 62. The swivel disc 42 includes a curved outer surface 106 as well as a curved inner surface 108, which is best shown in FIG. 7. The swivel disc 42 is preferably formed from steel to provide the required strength, durability and stability for the continued pivoting movement of the seat shell relative to the stationary base. The swivel disc 42 could be formed from other materials, such as polycarbonate, while operating within the scope of the present disclosure. The radius of curvature of the outer surface 106 generally corresponds to the curvature of the support surface 72 of the base 34 while the curvature of the inner surface 108 generally corresponds to the curvature of the contact surface 60 of the seat shell 12.

In the embodiment shown in FIG. 8, the swivel disc 42 includes a pivot opening 110. The pivot opening 110 is a removed portion of the swivel disc 42 that extends through the pivot disc from the outer surface 106 to the inner surface 108. The pivot opening 110 is defined by an outer edge 112. The outer edge 112 defines a front portion 114 and a rear portion 116. The width of the rear portion 116 is greater than the width of the front portion 114.

As can be understood in FIG. 8, the shape of the pivot limiting opening 64 formed in the contact surface 60 of the seat shell 12 defines a pivot limiting guide that limits the pivoting movement of the seat shell 12 relative to the base 34. The pivot opening 110 formed in the swivel disc 42 is slightly larger and generally corresponds to the shape of the pivot limiting opening 64 formed in the contact surface 60 of the seat shell 12. The size of the pivot opening 110 allows the bumper and pivot post to freely move relative to the swivel disc 42 such that the pivot limiting guide formed on the seat shell limits the movement of the seat shell 12.

Figure 10:
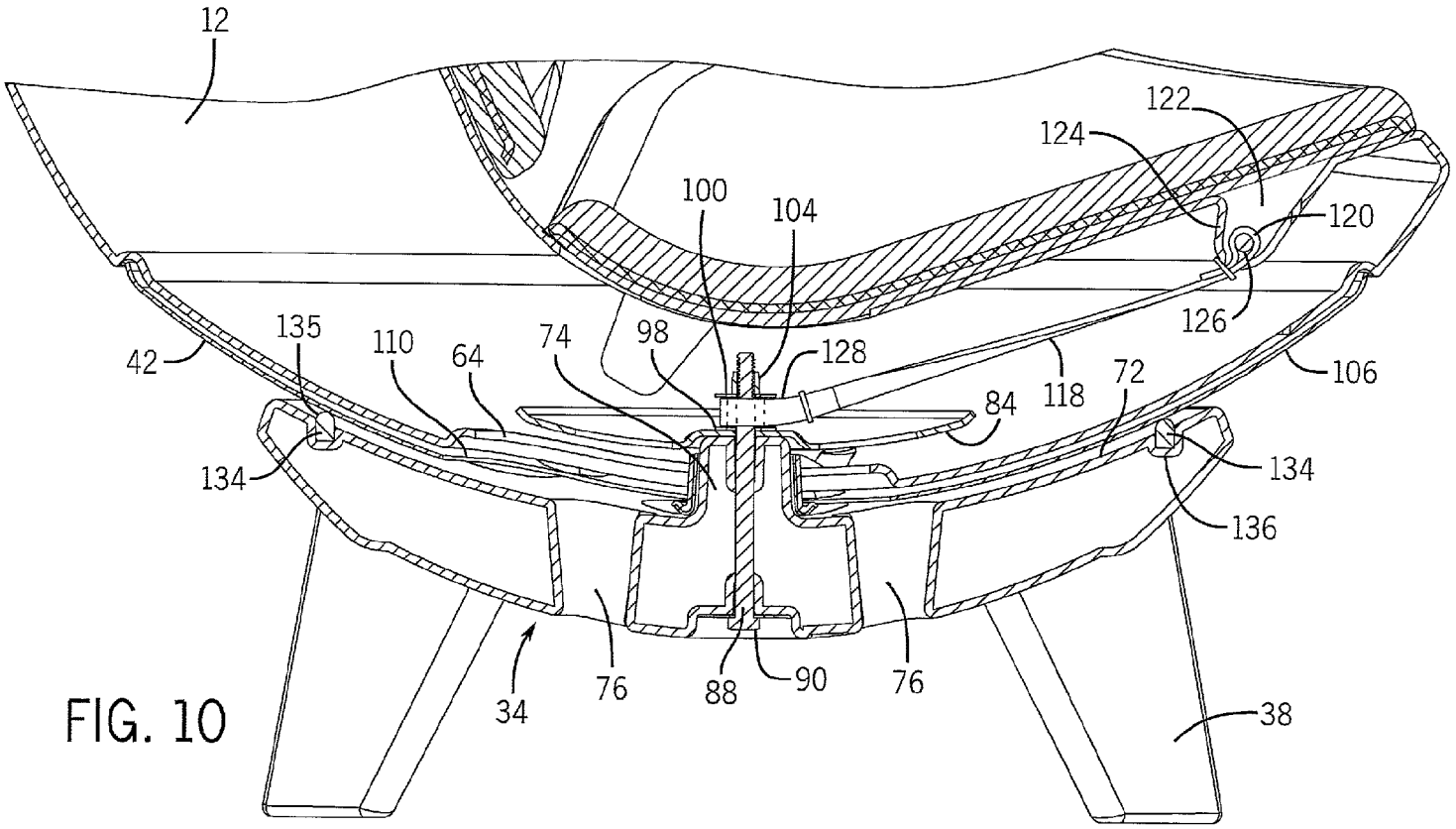
FIG. 10 is a magnified, partial section view taken from FIG. 9.

As illustrated in FIG. 10, the base 34 includes a plurality of glide buttons 134 that are each received within a mounting hole 136 that extends into the base from the support surface 72. Each of the glide buttons 134 are formed from a wear resistant material, such as UHMW polyethylene. As can be seen in FIG. 10, each of the glide buttons include a curved, upper surface 135 that contacts the outer surface 106 of the swivel disc 42 and generally spaces the outer surface 106 from the support surface 72 of the base 34. The glide buttons 134 allow the swivel disc 42 to move relative to the base and create a wear surface that could be replaced when worn. As can be seen in FIG. 7, the plurality of glide buttons 134 are spaced around the outer circumference of the center section 40 to provide spaced support for the seat shell and the associated swivel disc 42.

Referring now to FIG. 10, the lounge chair includes a bias member 118 that is designed to create a bias force to urge the seat shell 12 into an upright, resting position. The bias member 118 is depicted as a tether in FIGS. 7-12 and as a spring in FIGS. 13-15. It should be recognized that other types of bias members, as well as a combination of those disclosed, are contemplated in the present disclosure. In embodiments having a tether as the bias member 118, the bias member 118 is preferably formed from a resilient material, such as rubber. A first end 120 of the bias member 118 is securely retained within an attachment opening 122 formed in a recessed portion 124 of the seat shell. In the embodiment shown in FIG. 10, an attachment rod 126 holds the first end 120 within the attachment opening 122.

A second end 128 of the bias member 118 is securely attached to the bolt 88 that extends through the pivot post 74. The second end 128 of the bias member 118 is coupled to the bushing located between the upper and lower washers 98, 100 and is held in such a position by the nut 104. In this manner, the bias member 118 has a first end 120 connected to the seat shell 12 and a second end 128 connected to the pivot post 74 of the base 34.

Figure 11:
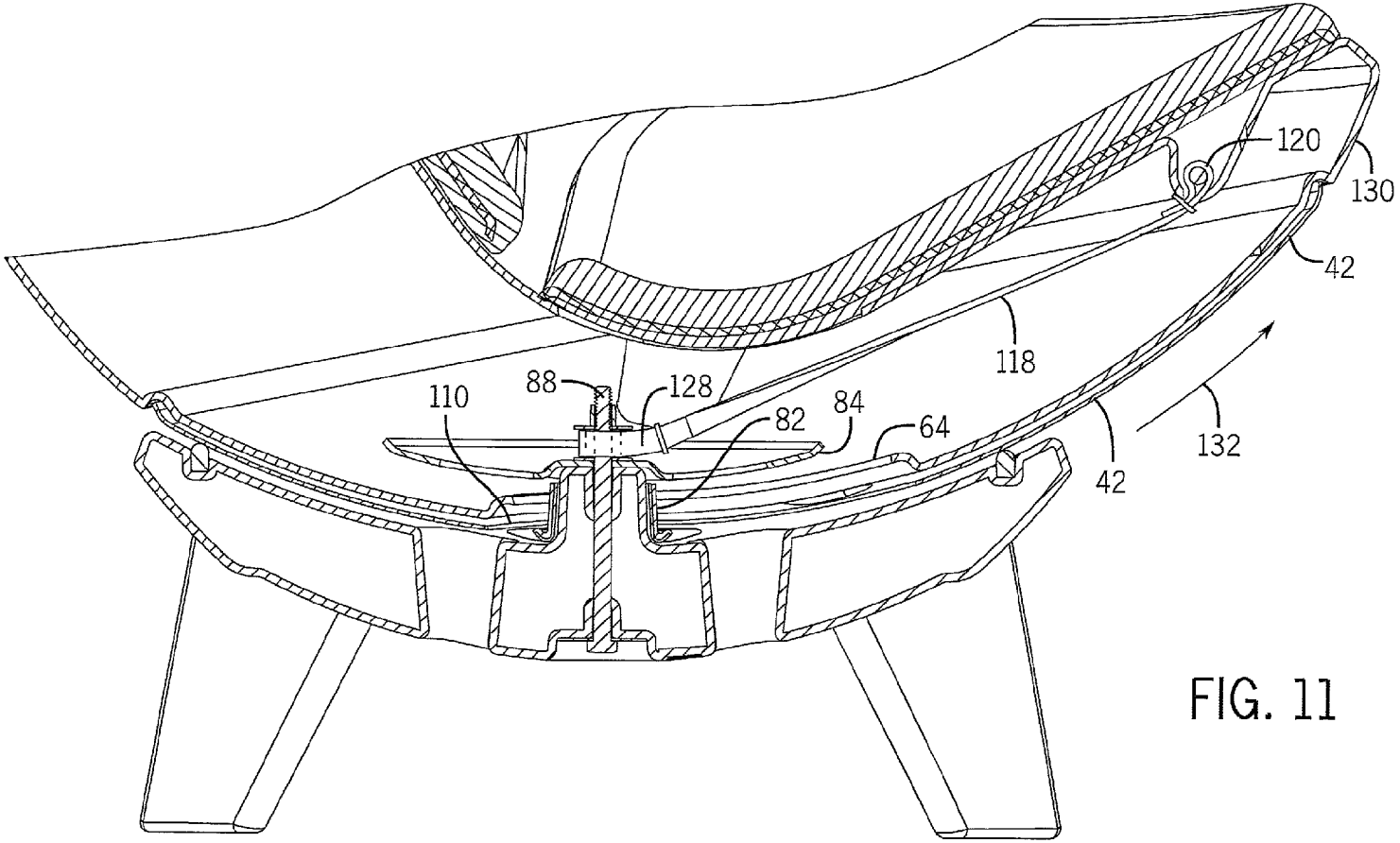
FIG. 11 is a magnified, partial section view similar to FIG. 10 showing the pivoting movement of the lounge chair of FIG. 7.

Referring now to FIG. 11, when a user is seated in the lounge chair, the user can lean back, which causes the chair back to recline, thus causing the front portion 130 of the seat shell to move in the direction illustrated by arrow 132. During this pivoting movement, the length of the bias member 118 is increased. At the same time, the bumper 82 travels within the pivot limiting opening 64 formed in the contact surface of the seat shell. The seat occupant is able to recline until the bumper 82 contacts the guide edge surface that defines the pivot limiting opening 64. At this position, generally shown in FIG. 11, the reclining movement of the seat shell is halted.

Figure 12:
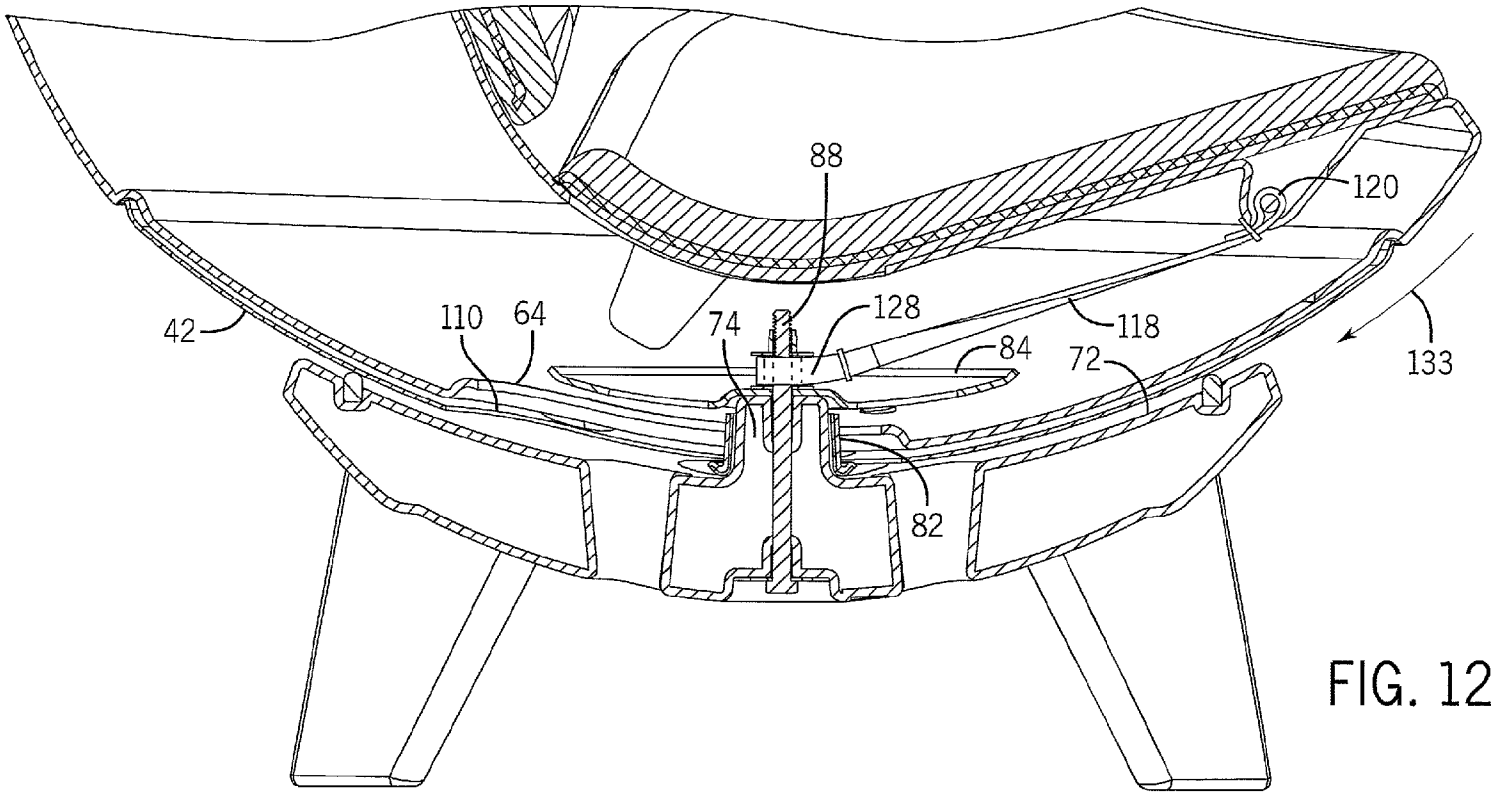
FIG. 12 is a partial section view of the lounge chair of FIG. 7 similar to FIG. 11 showing pivotal movement in an opposite direction.

If the seat occupant wishes to return to a more upright position, as shown by arrow 133 in FIG. 12, the user leans forward, which causes the bumper 82 surrounding the pivot post 74 to move within the pivot limiting opening 64 toward the front portion of the pivot limiting opening. The movement of the seat shell relative to the base is aided by the bias force created by the bias member 118. The fully upright position of the seat shell is defined by the shape and configuration of the pivot limiting opening 64. In the fully upright position, the bias member 118 is slightly extend from a relaxed condition such that the bias member 118 holds the seat shell in the upright position and holds the bumper 82 against the guide edge of the pivot limiting opening in the seat shell.

Although the pivot limiting guide is shown and described as being the pivot limiting opening 64 formed in the seat shell, it is contemplated that the pivot limiting guide could alternatively be formed on the swivel disc 42. In such an embodiment, the pivot opening 110 would be properly sized to contact the bumper 82 to limit the pivoting movement of the seat shell relative to the base. In such an embodiment, size of the pivot limiting opening 64 in the seat shell would be increased such that only the pivot opening 110 in the swivel disc would contact the bumper 82.

Figure 13:
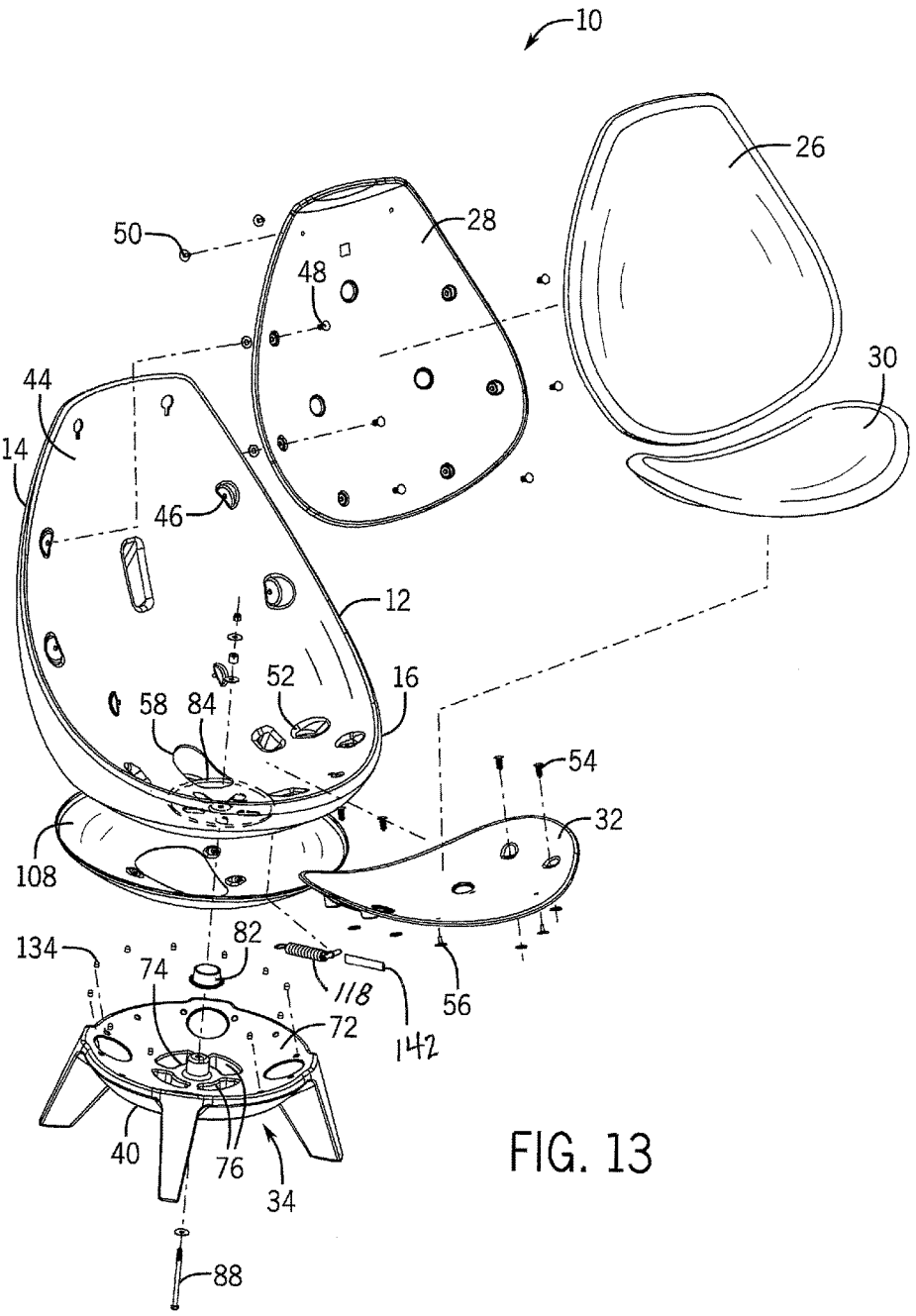
FIG. 13 is an exploded, isometric view similar to FIG. 7 of an embodiment having a spring as the bias member.
Figure 14:
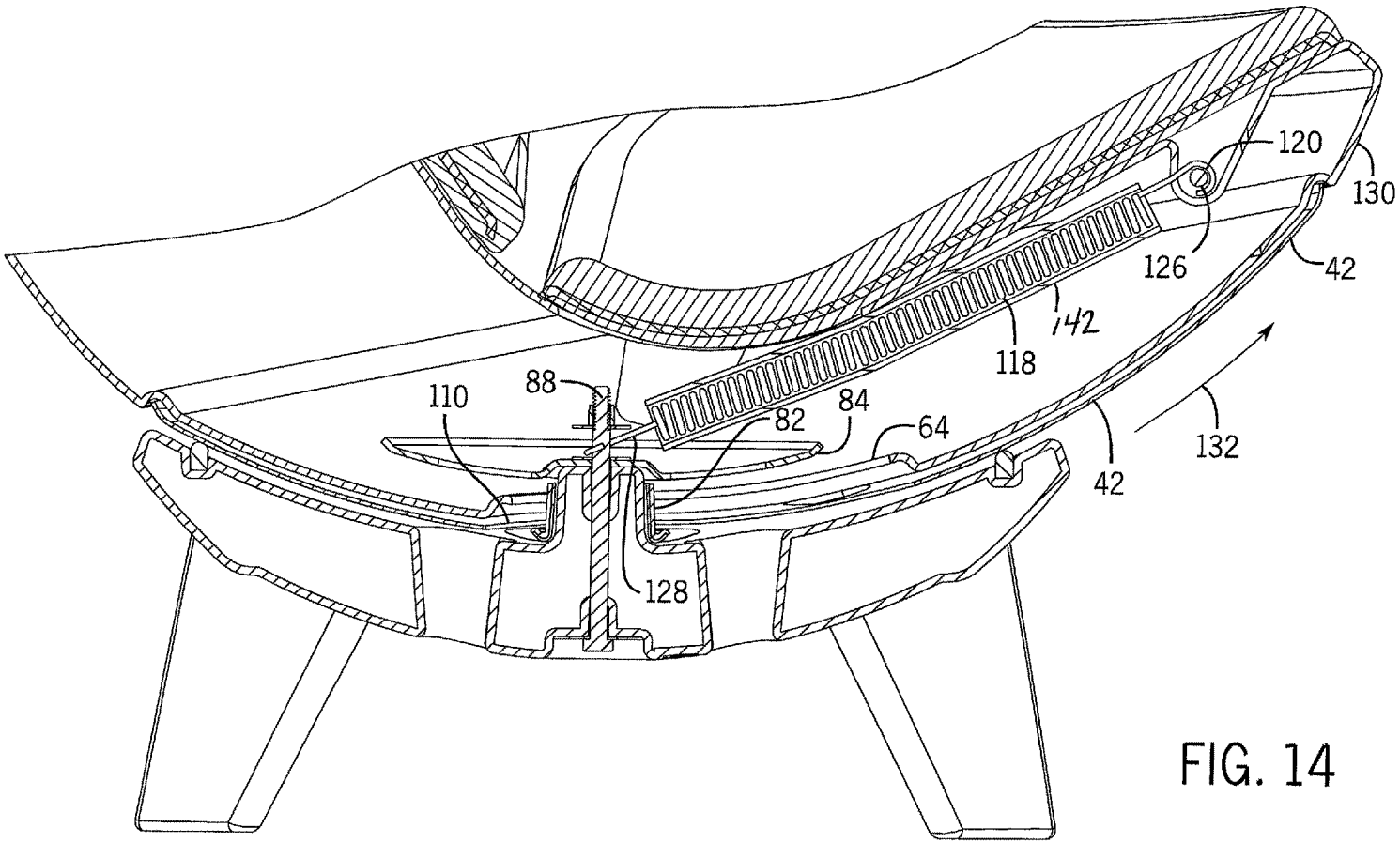
FIG. 14 is a magnified, partial section view of the lounge chair of FIG. 13 similar to FIG. 11.
Figure 15:
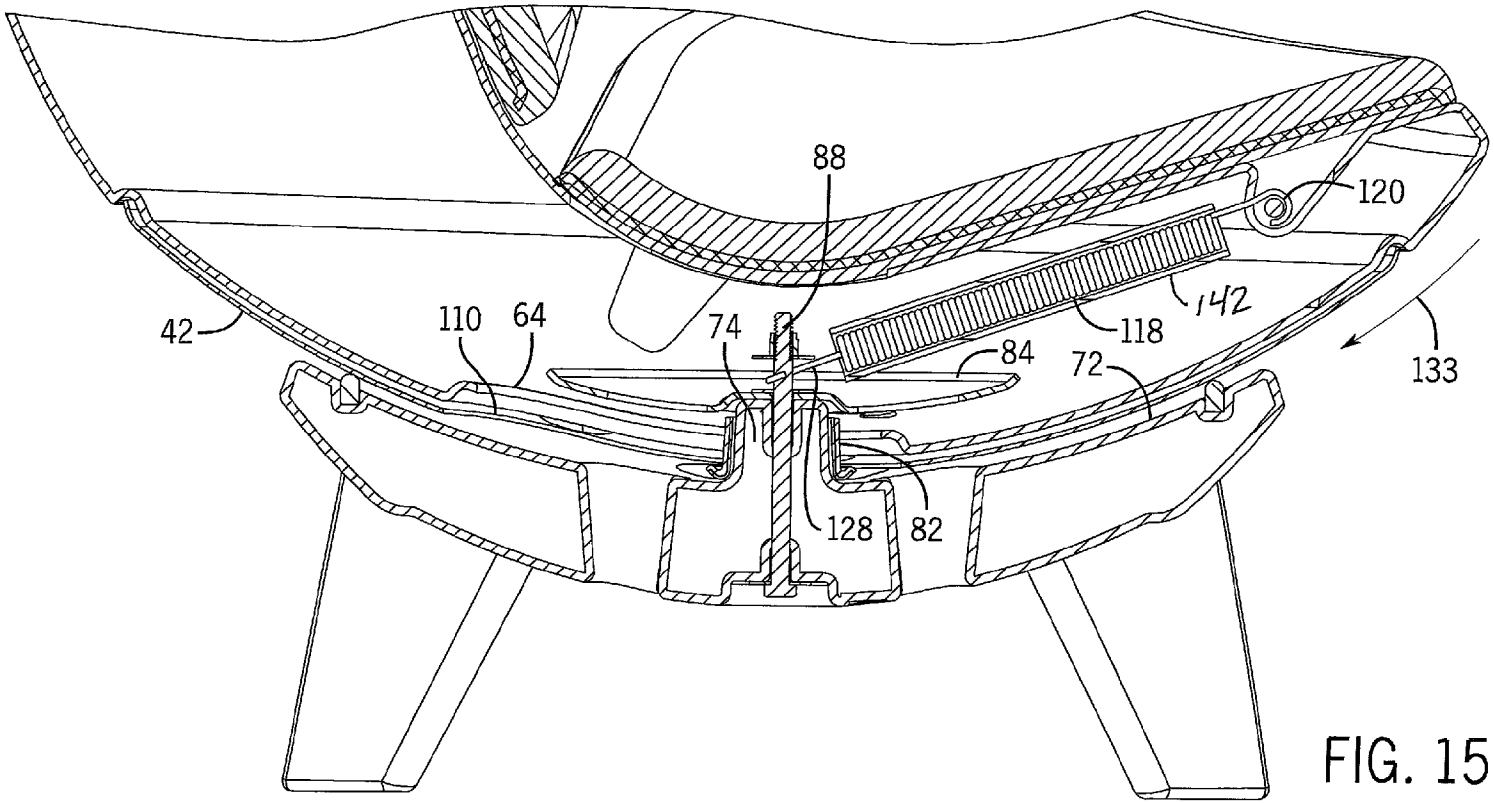
FIG. 15 is a magnified, partial view of the lounge chair of FIG. 13 similar to FIG. 12.

FIGS. 13-15 depict a lounge chair 10 similar to that shown in FIGS. 7-12, but having a spring as the bias member 118. In embodiments having a spring as the bias member 118, the bias member 118 is preferably formed of coiled spring steel and is preferably enclosed along the sides of its length by a cylindrical sleeve 142, as shown in FIGS. 14-15. As illustrated in FIGS. 14 and 15, the spring includes the first end 120 that is securely retained within the attachment opening formed in the recessed portion of the seat shell. In the embodiment shown in FIG. 14, the attachment rod 126 holds the first end 120 within the attachment opening.

A second end 128 of the spring is securely attached to the bolt 88 that extends through the pivot post. The second end 128 of the spring is coupled to the bushing located between upper and lower washers 98, 100 and is held in such a position by the nut 104. In this manner, the spring 128 has a first end 120 connected to the seat shell and a second end 128 connected to the pivot post of the base, as in the embodiment previously described.

The movement of the lounge chair shown in FIGS. 13 and 14 is substantially the same as described in the embodiment of FIGS. 11 and 12. It should be recognized that while the embodiments having a spring as the bias member 118 describe and depict using a coil spring, alternative forms of springs are readily recognizable in the art and contemplated as being within the scope of the present disclosure.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A lounge chair, comprising:

a seat shell having a hollow interior, integrally formed seat and chair back and a convex bottom contact surface;

a base having a concave support surface that generally corresponds to the convex bottom contact surface of the seat shell;

a pivot post extending from the support surface of the base and into the hollow interior of the seat shell when the seat shell is received on the base;

a swivel disc positioned between the contact surface of the seat shell and the support surface of the base;

a pivot limiting guide that contacts the pivot post to limit the pivoting movement of the seat shell relative to the base; and a bias member positioned between the seat shell and the base to bias the seat shell into a seating position.

2. The lounge chair of claim 1 wherein the bias member is a tether.

3. The lounge chair of claim 2 wherein the contact surface of the seat shell includes a pivot limiting opening defined by a guide edge surface that contacts the pivot post to form the pivot limiting guide.

4. The lounge chair of claim 1 wherein the bias member is a spring.

5. The lounge chair of claim 1 wherein the pivot limiting guide is formed in the seat shell, and wherein the swivel disc is formed from steel and the swivel disc includes a concave upper surface and a convex lower surface.

6. The lounge chair of claim 1 further comprising a plurality of glide buttons received in the base and each extending from the bottom contact surface.

7. The lounge chair of claim 6 wherein each of the glide buttons is formed from UHMW polyethylene.

8. The lounge chair of claim 6 wherein the swivel disc slides along the glide buttons during pivoting movement of the seat shell.

9. The lounge chair of claim 1 further comprising a retaining disc positioned in the open interior of the seat shell and secured to the pivot post.

10. A lounge chair, comprising:

a seat shell having a hollow interior, integrally formed seat and chair back and a convex bottom contact surface;

a base having a concave support surface that generally corresponds to the convex bottom contact surface of the seat shell;

a pivot post extending from the support surface of the base and into the hollow interior of the seat shell when the seat shell is received on the base;

a swivel disc positioned between the bottom contact surface of the seat shell and the support surface of the base; and a pivot limiting guide formed in the seat shell, wherein the pivot limiting guide contacts the pivot post to limit the pivoting movement of the seat shell relative to the base; and a bias member positioned between the seat shell and the base to bias the seat shell into a seating position.

11. The lounge chair of claim 10 wherein the bias member is connected between the seat shell and the pivot post.

12. The lounge chair of claim 11 wherein the bias member is formed from a resilient material.

13. The lounge chair of claim 10 wherein the bias member is a tether.

14. The lounge chair of claim 10 wherein the bias member is a spring.

15. The lounge chair of claim 10 further comprising a plurality of glide buttons received in the base and each extending from the bottom contact surface, wherein the swivel disc includes a concave upper surface and a convex lower surface, and wherein the swivel disc slides along the glide buttons during pivoting movement of the seat shell.

16. The lounge chair of claim 10 further comprising a retaining disc positioned in the open interior of the seat shell and secured to the pivot post.

17. A lounge chair, comprising:

a seat shell having a convex bottom contact surface;

a base having a concave curved support surface that generally corresponds to the convex bottom surface of the seat shell;

a pivot post extending from the support surface of the base, wherein contact between the pivot post and a pivot limiting opening formed in the contact surface of the seat shell limits the pivoting movement of the seat shell relative to the base;

a swivel disc positioned between the bottom contact surface of the seat shell and the support surface of the base; and a bias member positioned between the seat shell and the base to bias the seat shell to a seating position.

18. The lounge chair of claim 17 wherein the bias member is a tether formed from a resilient material and is connected between the seat shell and the pivot post.

19. The lounge chair of claim 17 wherein the bias member is a spring connected between the seat shell and the pivot post.

* * * * *